US006225580B1

(12) United States Patent
Lemire

(10) Patent No.: US 6,225,580 B1
(45) Date of Patent: May 1, 2001

(54) ROTARY SWITCH CONTAINED INSIDE A KNOB

(75) Inventor: Paul Lemire, Bum Pass, VA (US)

(73) Assignee: Electronic Hardware Corporation, Farmingdale, NY (US)

( * ) Notice: Subject to any disclaimer, the term of this patent is extended or adjusted under 35 U.S.C. 154(b) by 0 days.

(21) Appl. No.: 09/474,145

(22) Filed: Dec. 29, 1999

Related U.S. Application Data

(60) Provisional application No. 60/114,259, filed on Dec. 30, 1998.

(51) Int. Cl.[7] ..... H01H 19/54

(52) U.S. Cl. ..... 200/11 DA; 200/11 R; 200/11 D; 200/564; 200/571; 200/277

(58) Field of Search ..... 200/11 R–11 TW, 200/17 R, 564, 565, 570–572, 252, 277, 329, 336

(56) References Cited

U.S. PATENT DOCUMENTS

| | | | | |
|---|---|---|---|---|
| 4,527,023 | * | 7/1985 | Ohashi et al. | 200/11 G |
| 4,837,413 | * | 6/1989 | Schwab et al. | 200/11 R |
| 5,039,830 | * | 8/1991 | Orillard | 200/61.39 |
| 5,227,595 | * | 7/1993 | Sorenson et al. | 200/11 J |
| 5,847,345 | * | 12/1998 | Harrison | 200/284 |
| 5,959,269 | * | 9/1999 | Bauer et al. | 200/11 R |
| 5,994,654 | * | 11/1999 | Benson | 200/283 |

* cited by examiner

*Primary Examiner*—Michael Friedhofer
(74) *Attorney, Agent, or Firm*—Nolte, Nolte & Hunter; Christopher B. Garvey

(57) ABSTRACT

A rotary switch is contained inside a knob. The switch operates on a surface of an electrical device. The switch has a rotating housing, an axle, an axle bearing, switch contacts, and a knob, in which the knob is the housing, and the knob, axle, axle bearing, and switch contacts are all located external to the surface of the electrical device, and are all contained within a space defined by a surface of the knob.

15 Claims, 7 Drawing Sheets

ROTARY SWITCH CONTAINED INSIDE A KNOB

CROSS-REFERENCE TO RELATED APPLICATION:

This application is a conversion of a provisional application No. 60/114,259, filed Dec. 30, 1998 and claims benefit of that provisional application.

STATEMENT REGARDING FEDERALLY SPONSORED RESEARCH OR DEVELOPMENT:

None.

REFERENCE TO APPENDIX:

None.

BACKGROUND OF THE INVENTION:

1. Field of Invention

The present invention relates to a rotary switch for mounting on a panel. Particularly it relates to a rotary switch contained inside a knob so that the entire apparatus maybe mounted on a front of a panel without locating additional apparatus behind a panel. The invention further relates to a novel arrangement for contacts and detents in various positions of the rotary switch.

2. Description of the Related Art Including Information Disclosed Under 37 CFR 1.97 and 1.98

Conventional rotary switches typically have a switch body which is designed to be mounted on the backside of a panel, generally by a threaded shaft housing, which goes through the panel, and by a pair of nuts on the housing threads which clamp on either side of the panel. From the threaded housing, a shaft protrudes through the front of the panel. A knob is mounted by press-fit, by set screw such as an Allen Key, or by splines to the shaft, for rotary control of the switch from outside the panel. While the industry has been generally satisfied with the arrangement, it does have the disadvantage of requiring the panel to be open, so that access to both the inside and outside of the panel is necessary in order to install the switch. Contacts typically have to be attached at the inside of the panel. The switch has to be inserted into a hole on the panel face from the inside, and then the knob has to be installed to the shaft after the switch has been secured to the panel.

BRIEF SUMMARY OF THE INVENTION

The present invention seeks to obviate these installation and replacement difficulties by self-containing the entire apparatus within the knob assembly itself. Thus, the knob can be mounted by glue, snap fasteners, bayonet contacts, or any other means of attaching components to an outside surface, without opening the panel. The contacts can be accessible from the outside of the panel for mating with the circuitry of the switch assembly. Among the objects accomplished by this design are:

Saving of precious space within the instrument package, reduced weight, reduced assembly time in manufacturing, and the provision of customary rotary action and detent positions, either with or without internal mechanical stops.

The switch in the present invention may have printed circuit pins and surface mounts for direct circuit board connection. Blind leads may be provided for attachment to the switch. A flex circuit or ribbon cable may be provided for remote mounting on a panel or chassis.

Figure 1:
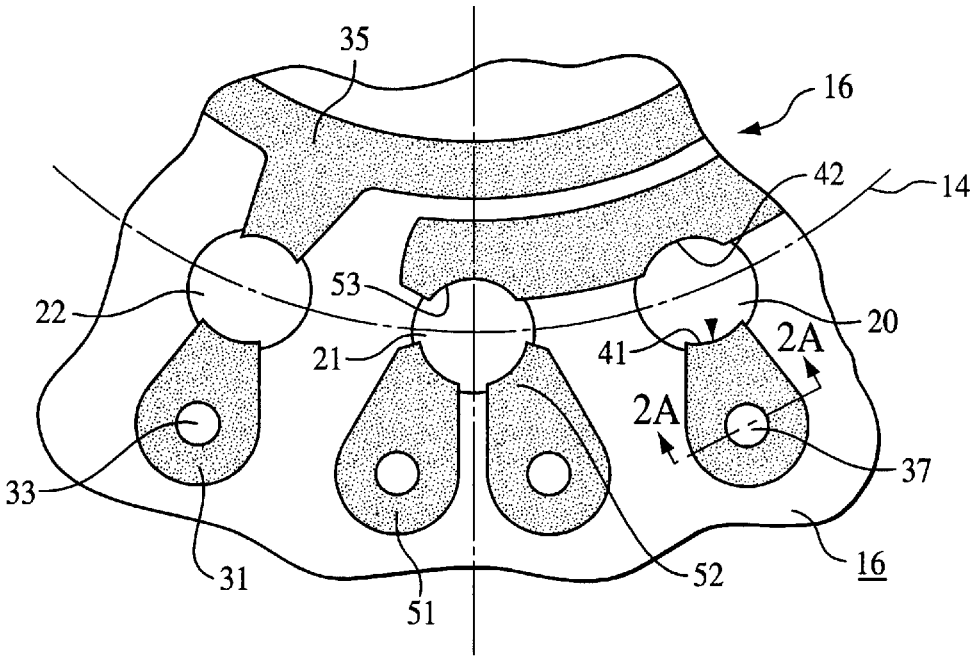
FIG. 1 is a plan view of part of a circuit board, on the plane shown in FIG. 2, within the switch of the present invention, comprising conductor segments plated upon the circuit board to serve as contacts and detent holes.

DETAILED DESCRIPTION OF THE INVENTION:

As shown in FIGS. 1–4, electrical contact is accomplished by spring loaded provision of a metal ball 12, in an insulated carrier 13. Ball 12 rolls or slides in a controlled path 14 (FIGS. 1 and 4) over a printed circuit type commutator generally designated 16. In FIG. 1, contact positions are round holes, 20–22 approximately 70% of the ball's diameter and are located in the ball's path 14. The edges of the holes have conductive segments, such as 31, leading away to the components' interface 33 or to other internal function 35. Contact 31 may be plated through hole 33.

Figure 2:
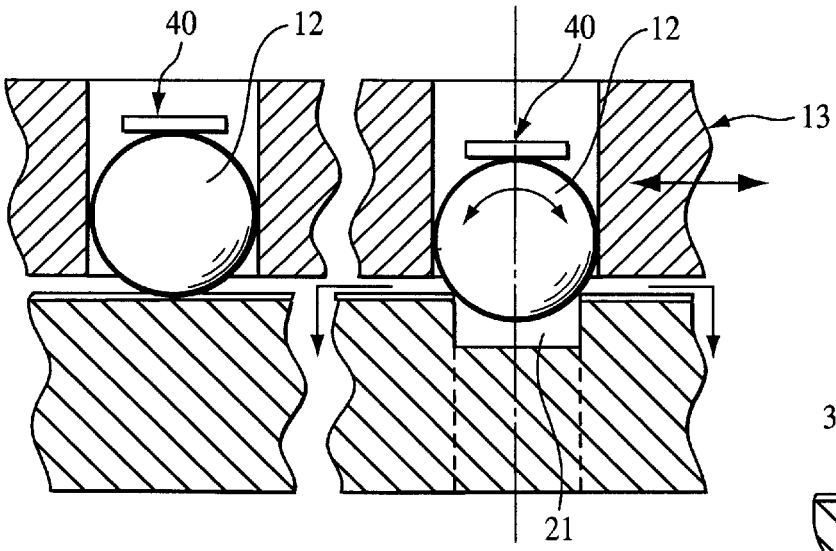
FIG. 2 is an elevation in section, showing spring loaded shunt balls as they travel in a rotating ball carrier across the surface shown in FIG. 1.
Figure 2A:
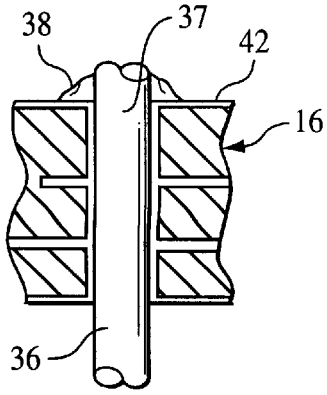
FIG. 2A is an elevation in section through a plane in FIG. 1.

FIG. 2A shows interface pin wire 36 through hole 37 soldered 38 to contact 41.

Contact is made when the ball 12 (FIG. 2 and FIG. 4), under spring force 40, drops into the hole such as 22, shunting, as in FIG. 1, the slightly embossed conductive segments 51–53, or such as 41–42 on hole 20 recess 43 shows a selectively shaped recess which is ramped on one side 43*a* and conforms to the ball-shape on the other side 43*b*, and is of sufficient depth (equal to or greater than the radius of ball 12*c*) that the ball cannot climb out of side 43*b*, so that side 43*b* constitutes a directional stop. The knob cannot be turned to bring the shunt ball out in the direction of 43*b* but can be turned so that the ball follows ramp 43*a* to rotate the knob in that direction. It can readily be seen that a vertical wall on side 43*b* would also accomplish the same function, as would other slopes that were not sufficiently shallow to allow shunt ball 12*c* to climb out of recess 43. As many as three contacts 51, 52, 53 can be connected by the ball 12 at each recess such as 21. A fourth contact can be picked off the ball 12 itself through the spring 40 (FIG. 2).

Figure 3:
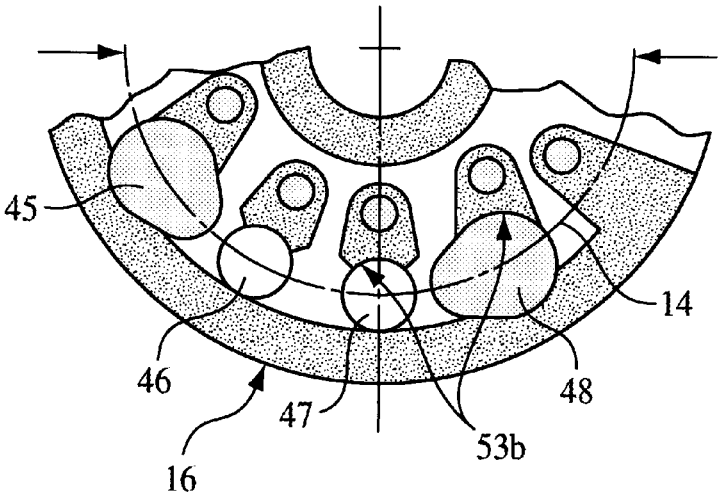
FIG. 3 is a plan view at plane 3 of FIG. 4 similar to FIG. 1 showing different detent possibilities, and a slightly different circuit arrangement of a rotor segment of the circuit board.
Figure 4:
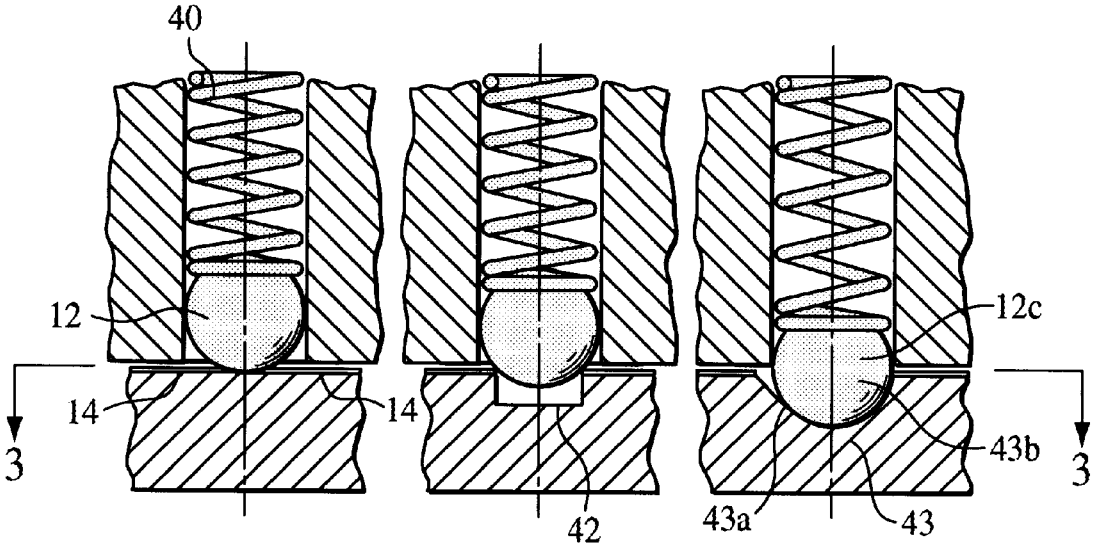
FIG. 4 is another elevation in section illustrating how the shunt ball and it's spring interacts with various shaped detents shown in FIG. 3.

The contact action also provides the detent tactile response and position security typically required by such a component. Multiple contact paths containing several balls are feasible with this design. Contact spacing and configuration can be easily customized to suit functional requirements. FIG. 3 shows different hole shapes 45–48 which will give different tactile sensations to the various different stops.

As shown in FIG. 3, holes such as 53A may be plated through for interlayer connections or for connections to the component's system interior.

Plating 16, on the circuit board that comprises the surface of the contact board, is a typical commutator printed circuit board clad pattern. Edges 53B of contact recesses such as 42 and 43 have embossed conductor segments from the plating process which provides additional thickness for contact with the shunt balls such as 12 and 12*c*.

Figure 5:
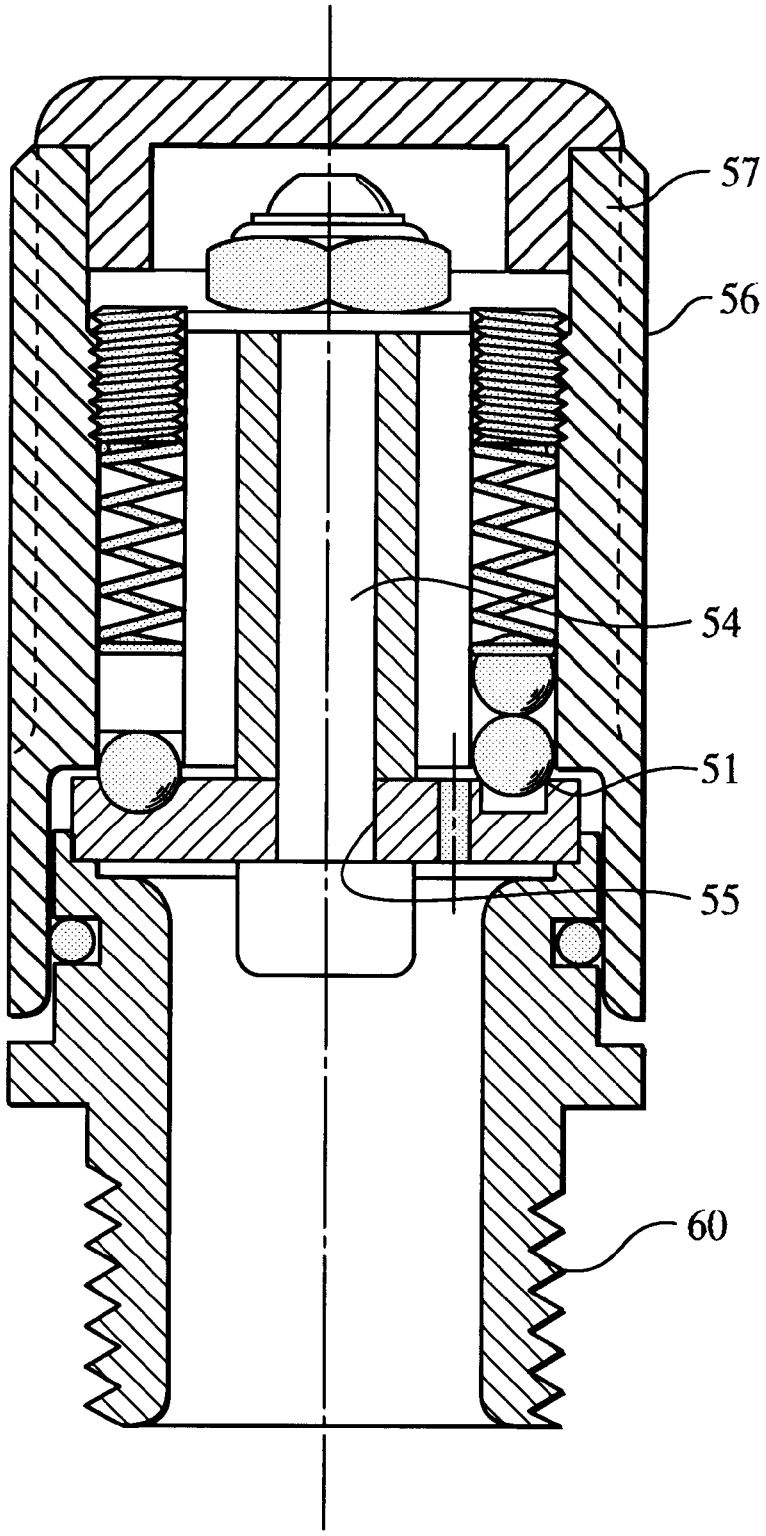
FIG. 5 is an elevation, in section through its middle, showing one embodiment of the switch.

As in FIG. 5, axle 54, axle bearing 55, and switch contacts such as 51, are all located inside a space defined by surface 56 of knob 57.

Figure 6:
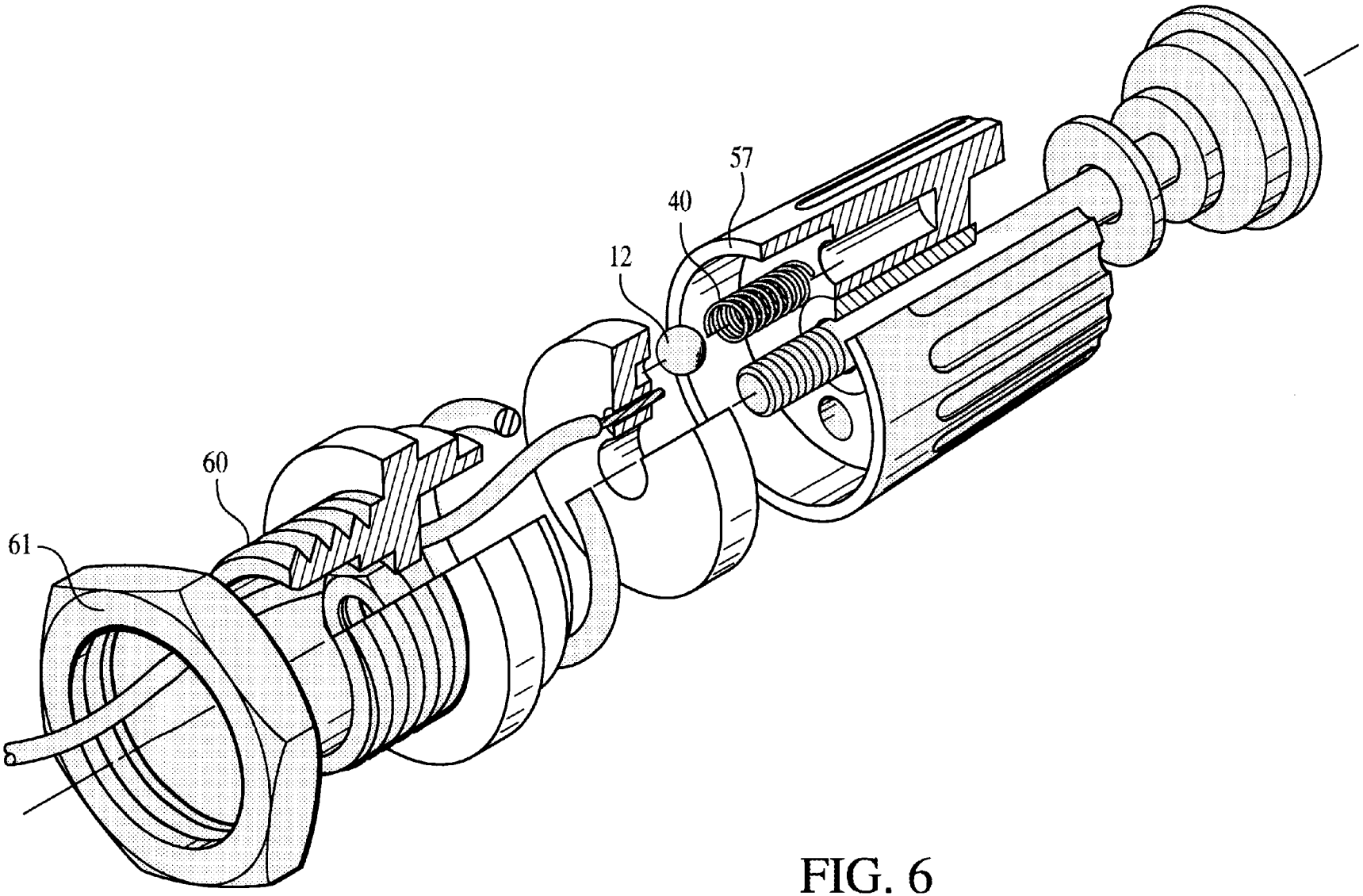
FIG. 6 is an exploded view thereof.
Figure 7:
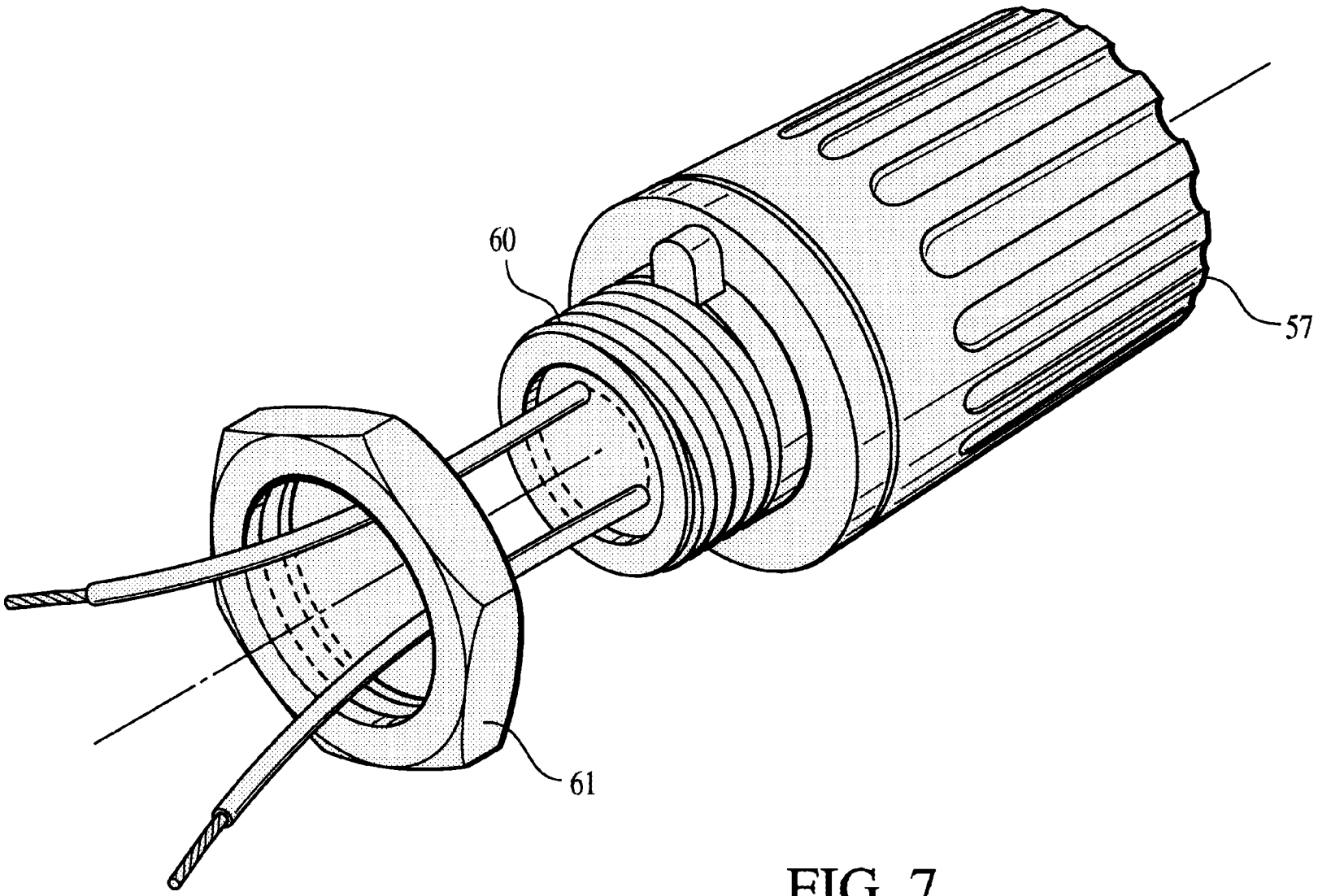
FIG. 7 is a assembled view showing a pair of leads and a nut designed to attach the rotary switch in a somewhat conventional fashion to a control panel face.

While the inventor envisions a host of mounting arrangements in which some have mounting pins which serve also as connectors, in which bayonet fasteners snap easily upon the surface, and in which electrical connectors supply the mounting base, the presently preferred embodiment shown in FIG. 5 and FIG. 6 has the advantage of providing a mounting shaft 60 and nut 61, which can be utilized in existing circuits that are designed for the conventional switch of today, in which the switch mechanism sits behind the control panel face. Advantages here are interchangeability with existing components, and a resulting marketably However, it is envisioned that various mounting arrangements will evolve, as described previously, which take advantage of the surface-mountability of this design.

Figure 8:
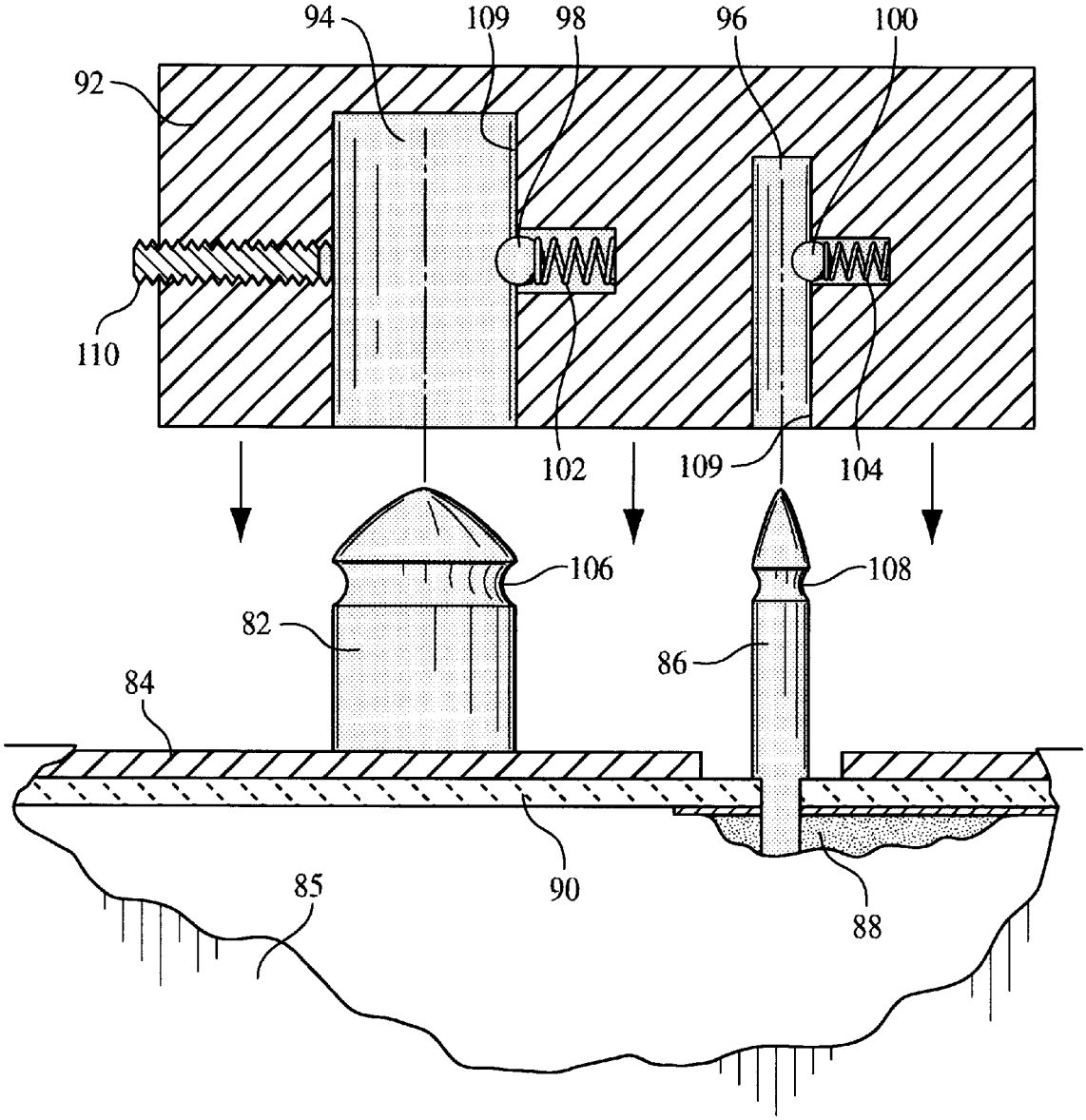
FIG. 8 is an elevation in partial section of a bayonet mount embodiment.

For example, FIG. 8 shows a bayonet mount embodiment of the present invention, which is one of a variety of possible configurations.

A pin 82 of a first polarity, such as a ground pin, is rigidly mounted in electrical contact with a conductive surface such as an exterior surface 84 of an electronic apparatus 85. A second pin 86, of opposite polarity, is mounted by a solder joint 88 onto an insulating circuit board 90 beneath surface 84.

Switch body 92 comprises bayonet sockets 94 and 96, which are sized to receive their respective pins 82 and 86 oriented in the proper polarity. Balls 98 and 100 are biased by spring 102, 104 to snap into recesses 106, 108 in pins 82, 86. Electrical contact with pins 82, 86 may be made by either or both balls 98, 100 and or the interior surfaces 109 of sockets 94, 96. Switch body 92 snaps onto pins 82, 86. Balls 98, 100 snap into recesses, then secure, to provide electrical contact to the switch in one simple operation. For additional security a set screw 110 may be provided to more securely hold switch body 92 to recess 106.

It can be readily be seen that this arrangement completely obviates the prior art: in which prior art the switch contacts are wired within the housing of the electronic apparatus, after mounting the switch on the face plate, which mounting requires opening the cover of the electronic apparatus.

Inexpensive components such as pins 82, 86 can be welded, soldered, glued, screwed or snapped into place during the assembly of the original electronic apparatus. Switches such as 92 can be quickly installed after the devices are assembled and can easily be replaced without opening the device up. Switches contain movable parts, and contain surfaces which are subject to corrosion and wear. Worn switches are among the more frequent contributors to the failure of electronic devices. It can therefore readily be seen that testing the circuit:

by removing a switch and testing its underlying contacts, without opening the housing, or by simply replacing the switch to determine how effective such replacement would be in repairing the component, is greatly facilitated by a switch embodiment which takes advantage of self-containment. The switch may be tested without opening the box.

Any number of pins in the socket may be provided to accomplish a multiplicity of selection functions in a selector switch. Alternatively, the pins may be located on the switch, and the sockets may be located on the device on which the switch is located.

Alternatively, the bayonet may be mounted by an independent locking device, while electrical contact is made by other means.

Figure 9:
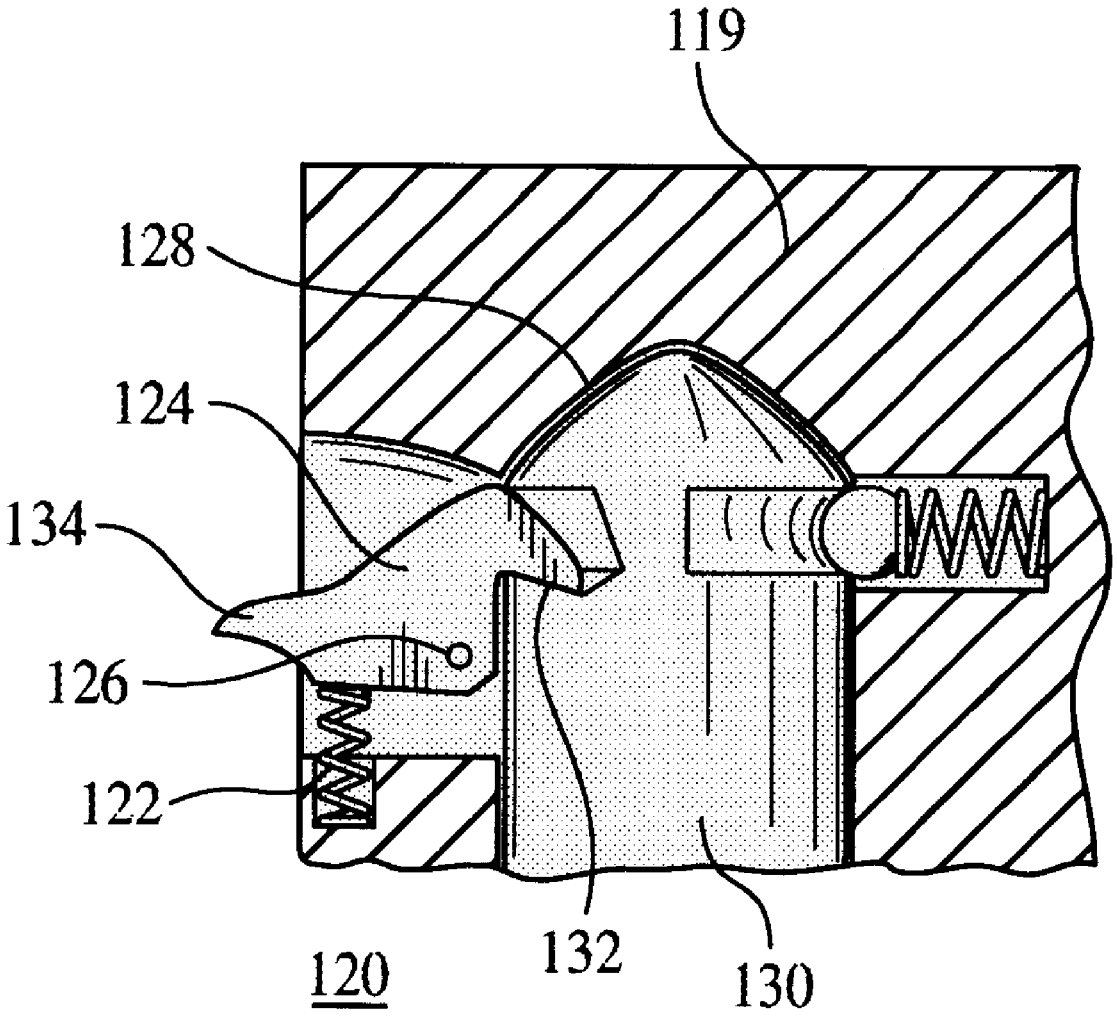
FIG. 9 is an elevation in section of another bayonet mount embodiment.

As in FIG. 9, the invention may have snap mount 120, comprising a spring 122 biasing a latch 124 mounted to pivot as on axle 126. Latch 124 ramps open when pushed by surface 128, on insertion of pin 130. Then spring 122 pushes latch to snap closed into recess 132. This arrangement allows the switch 119 to easily snap only on, but requires depression of an unlatching mechanism, such as tab 134, to remove switch 119 from pin 130.

The switch may be mounted on an external surface or may be mounted on a surface, such a component circuit board, which is within an electrical device, such as a computer.

Having described my invention I claim:

1. A switching apparatus for operation on a surface of an electrical device, said apparatus having:

a base, a rotating housing which serves as a knob, an axle and an axle bearing for mounting the housing rotationally on the base, switch contacts mounted on a contact surface, the knob, axle, axle bearing, and switch contacts are all located external to the surface of the electrical device;

a spring-loaded ball;

said switch contacts and spring loaded ball mounted between the base and the knob such that the base and the knob apply force from the spring through the ball against the switch contacts;

detents in the contact surface for receiving the ball and for thereby locating rotary action of the knob at discreet selectable positions; and the detents comprise:

recesses;

said recesses have insulated edges at the contact surface;

slightly embossed printed circuits protrude from said insulated edges to serve as said switch contacts to make electrical contact with the ball and thereby bridge said switch contacts.

2. Apparatus according to claim 1 in which the detents are selectively shaped to provide distinct tactile sensations, for a purpose of identifying and distinguishing between the discreet selectable positions.

3. Apparatus according to claim 1 in which one of the recesses is at least equal in depth to a radius of the ball and has one side too steep for the ball to climb, thereby creating a limiting stop of rotation of the knob in the direction of the too steep side.

4. A rotary switch contained inside a knob for operation on a surface of an electrical device, said switch having a base, rotating housing, an axle and an axle bearing rotationally mounting the housing to the base, switch contacts, and a knob, in which rotary switch:

the knob is the housing;

the switch contacts, axle, and axle bearing are all contained within a space defined by a surface of the knob;

the knob, axle, axle bearing, and switch contacts are all located external to the surface of the electrical device;

the base comprises a contact surface;

each of the switch contacts comprise a detent in the contact surface;

each of the detents has a perimetric edge at the contact surface;

each of the detents has contact surfaces at as many as three perimetric edge portions;

a spring-loaded ball is mounted in the knob for bridging the contact surfaces;

said detents receive the ball and thereby bias rotary action of the knob to various discreet selectable positions in which positions the ball is in a detent;

the detents are selectively shaped to provide distinct tactile sensations, for identifying and distinguishing between the various discreet selectable positions;

a surface mount is accessible and mountable to the surface of the device, without opening said device;

electrical contact is made between the device and the switch by mounting the base onto the device on the surface mount, without accessing an interior of the device; and the surface mount functions as an electrical mounting contact between the base and the device.

5. Apparatus according to claim 4 in which one of the recesses is at least equal in depth to a radius of the ball and has one side too steep for the ball to climb, thereby creating a limiting stop of rotation of the knob in the direction of the too steep side.

6. A switching apparatus having:

a base;

a housing, which serves as a knob rotationally mounted to the base;

a contact surface;

a spring-loaded ball;

said contacts surface and spring loaded ball mounted between the base and the knob such that the base and the knob apply force from the spring through the ball against the switch contact surface;

a recess in the contact surface for receiving the ball and for thereby locating rotary action of the knob at a position;

said recess having an insulated edge at the contact surface;

slightly embossed printed circuits protrude from said insulated edge to serve as switch contacts to make electrical contact with the ball and thereby bridge said switch contacts.

7. Apparatus according to claim 6 in which the recess is selectively shaped to provide tactile feel at the position.

8. Apparatus according to claim 7 in which the recess is a plan view circle of less recess diameter than the ball and thereby provides a force towards a center of the recess when a center of the ball goes over an edge of the recess.

9. Apparatus according to claim 7 in which:

the ball travels on a ball path;

the ball path is located on the contact surface;

the recess is at the ball path; and the recess has a tapered edge, in plan view, said edge providing a biasing force on the ball along the ball path towards a widest part of the recess.

10. Apparatus according to claim 7 in which the recess is at least equal in depth to a radius of the ball and has one side too steep for the ball to climb, thereby creating a limiting stop of rotation of the knob in the direction of the too steep side.

11. Apparatus according to claim 6 in which the recess is one of a plurality of recesses, each of the recesses is selectively shaped to provide tactile differential at a plurality of positions.

12. Apparatus according to claim 11 in which a circular recess of the plurality of recesses is a plan view circle of less recess diameter than the ball and said circular recess thereby provides a force towards a center of the circular recess when a center of the ball goes over an edge of the circular recess.

13. Apparatus according to claim 11 in which:

the ball travels on a ball path;

the ball path is located on the contact surface;

a tapered recess of the plurality of recesses is at the ball path; and the tapered recess has a tapered edge, in plan view, said tapered edge providing a biasing force on the ball along the ball path towards a widest part of the tapered recess.

14. Apparatus according to claim 11 in which a stop recess of the plurality of recesses is at least equal in depth to a radius of the ball and has one side too steep for the ball to climb, thereby creating a limiting stop of rotation of the knob in a direction of the too steep side.

15. Apparatus according to claim 11 in which:

the ball travels on a ball path;

the ball path is located on the contact surface;

a circular recess of the plurality of recesses is a plan view circle of less recess diameter than the ball and said circular recess thereby provides a force along the ball path towards a center of the circular recess when a center of the ball goes over an edge of the circular recess;

a stop recess of the plurality of recesses is at the ball path;

the stop recess has a ramped edge, said ramped edge providing a biasing force on the ball along the ball path towards a deepest part of the stop recess;

the stop recess is at least equal in depth to a radius of the ball and has one side too steep for the ball to climb, thereby creating a limiting stop of rotation of the knob in a direction along the ball path of the too steep side.

* * * * *